US006658707B2

(12) United States Patent
Guyard

(10) Patent No.: US 6,658,707 B2
(45) Date of Patent: Dec. 9, 2003

(54) FOLDING CLASP FOR INTERCHANGEABLE WATCH STRAP

(75) Inventor: Jean-Pierre Guyard, Orchamps-Vennes (FR)

(73) Assignee: Conseils et Manufactures VLG SA, Neuchatel (CH)

( * ) Notice: Subject to any disclaimer, the term of this patent is extended or adjusted under 35 U.S.C. 154(b) by 29 days.

(21) Appl. No.: 10/026,692

(22) Filed: Dec. 27, 2001

(65) Prior Publication Data

US 2002/0125276 A1 Sep. 12, 2002

(30) Foreign Application Priority Data

Mar. 12, 2001 (EP) ..... 01106017

(51) Int. Cl.[7] ..... A44C 5/00; A44C 5/18; A44C 5/24

(52) U.S. Cl. ..... 24/715; 24/265 WS; 224/164; 224/176

(58) Field of Search ..... 224/164, 176, 224/265 B, 265 WS, 715, 695, 705

(56) References Cited

U.S. PATENT DOCUMENTS 4,862,562 A * 9/1989 Perrin ..... 24/265 WS
6,029,320 A * 2/2000 Monneret et al. ..... 24/265 WS
6,493,908 B2 * 12/2002 Thalheim ..... 24/265 WS

FOREIGN PATENT DOCUMENTS

| | | | | |
|---|---|---|---|---|
| CH | 608 702 | | 1/1979 | |
| CH | 669501 | A5 * | 2/1989 | ..... 24/265 WS |
| CH | 671499 | A5 * | 9/1989 | ..... 24/265 WS |
| EP | 116384 | A2 * | 8/1984 | ..... 224/164 |
| EP | 0 287 475 | A1 | 10/1988 | |
| EP | 1 128 237 | A1 | 8/2001 | |
| FR | 2 442 605 | | 6/1980 | |

* cited by examiner

*Primary Examiner*—Sue A. Weaver
(74) *Attorney, Agent, or Firm*—Young & Thompson

(57) ABSTRACT

The folding clasp for an interchangeable watch strap comprises at least two arms articulated together and foldable against each other, provided with a fixing device to hold the clasp in closed position. The free end of one (1) of the arms (1, 3) is provided with a securement device for the end of a strap tongue (11) comprising a guide (8) having in cross-section a general U shape, an axle (9) connecting the two lateral wings of the guide (8) and holding members (10) adapted to coact with the upper surface of the tongue (11) of the strap. The free end of the other arm (3) of the clasp is pivoted on a cover (14) with the help of a screw (12), this cover (14) having lateral portions (13) interconnected by an axle (15). The cover (14) of the clasp comprises retaining members (16) adapted to coact with the upper surface of a second tongue (17) of the strap.

1 Claim, 3 Drawing Sheets

FOLDING CLASP FOR INTERCHANGEABLE WATCH STRAP

FIELD OF THE INVENTION

The present invention relates to a folding clasp for an interchangeable watch strap and more particularly for a flexible watch strap of leather, synthetic material, textile or the like.

BACKGROUND OF THE INVENTION

There exist watch straps which are provided with means permitting the user to change the strap himself without a tool. Thus, the user can secure to a watch case a metallic strap or a leather strap or any other type. In the case of leather straps, these latter are provided with buckles or folding clasps, but in this latter case each leather strap must necessarily be provided with such a clasp. This increases the price of the straps, particularly for items in precious metal because, in this case, the folding clasps must also be of precious metal.

OBJECT OF THE INVENTION

The object of the present invention is to give the user the possibility of himself removing, without a tool, the folding clasp of an interchangeable flexible strap, to install it on another flexible strap, for example of a different color or texture. Thus, a single folding clasp is necessary, no matter what the number of interchangeable straps the user possesses.

The interchangeable strap can for example be of the type described in European patent No. EP 1128237 A1 (European patent application No. 00103952.8 of Feb. 25, 2000 in the name of the applicant). It is however evident that the present invention is applicable equally to any other type of interchangeable strap that can be removably secured, even without a tool, on the watch case.

BRIEF DESCRIPTION OF THE DRAWINGS

The accompanying drawings show schematically and by way of example a particular embodiment of the folding clasp for an interchangeable watch strap according to the invention.

DETAILED DESCRIPTION OF THE INVENTION

Figure 1:
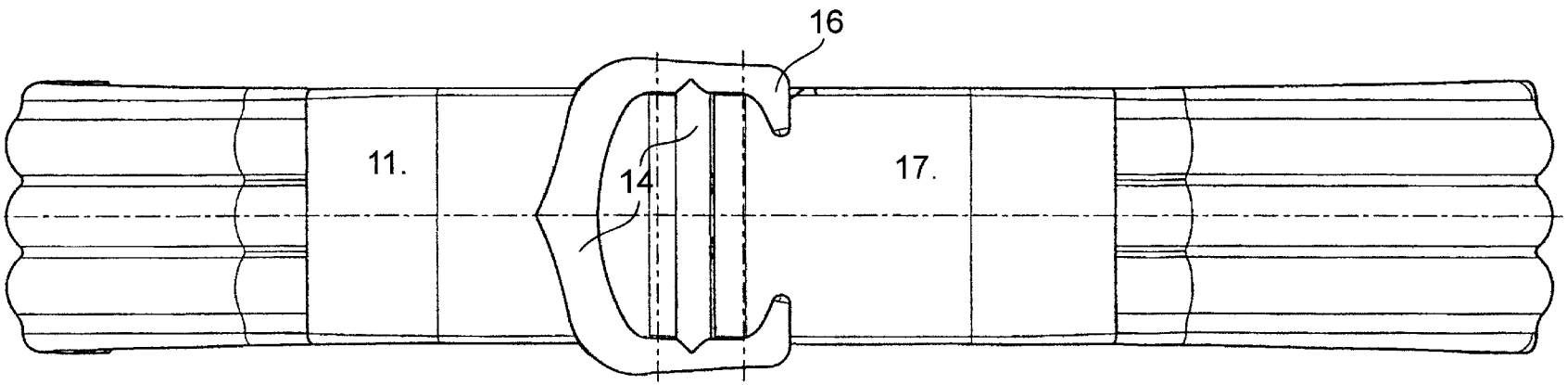
FIG. 1 is a fragmentary plan view of a watch strap provided with a folding clasp according to the invention, the clasp being in the closed condition.
Figure 2:
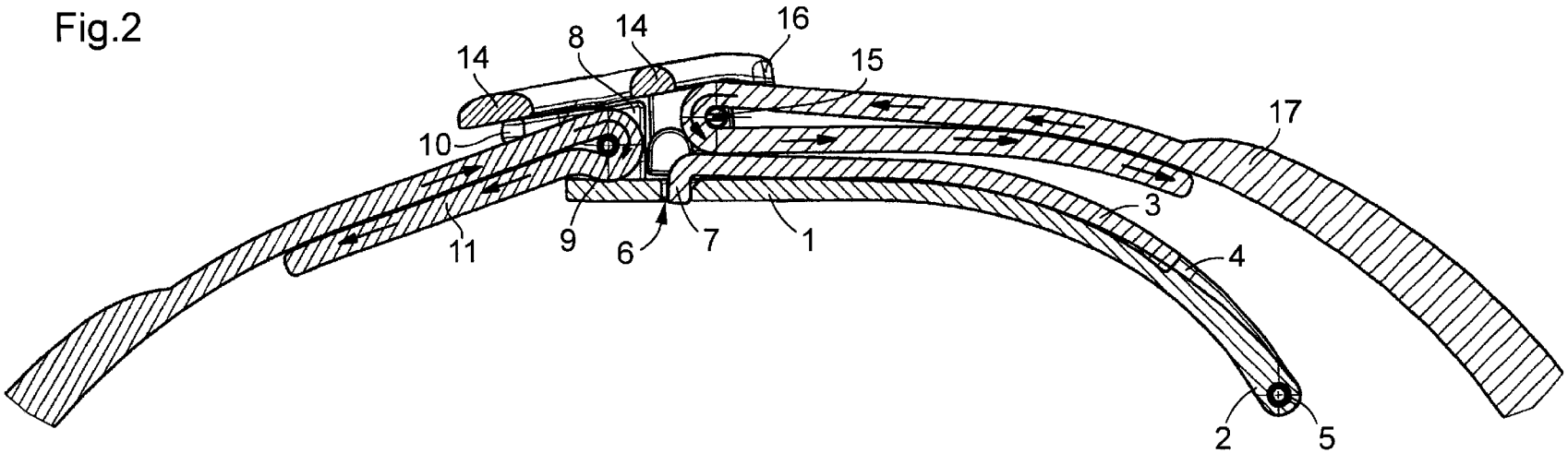
FIG. 2 is a cross-section on the line A—A of FIG. 1.
Figure 3:
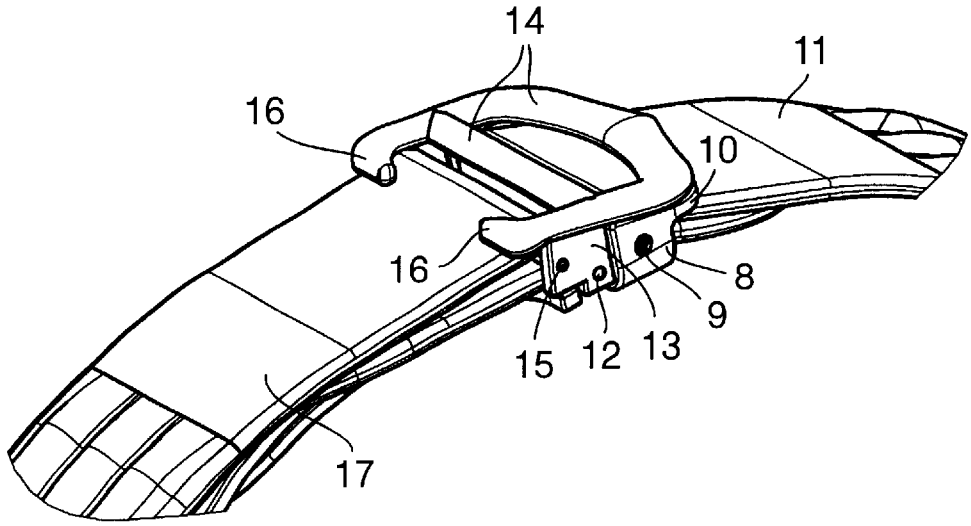
FIG. 3 is a perspective view of the folding clasp mounted on a strap, the clasp being in the closed condition.
Figure 4:
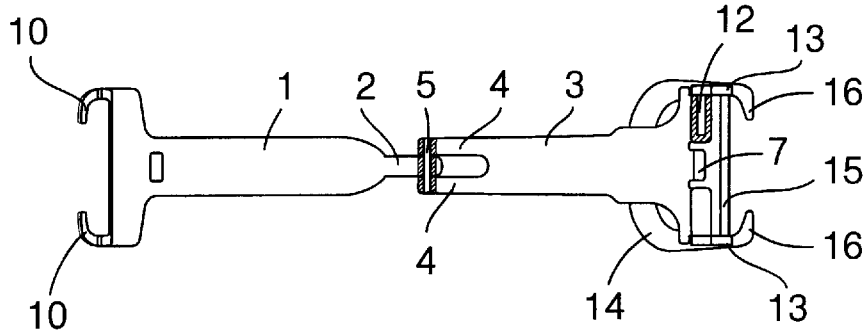
FIG. 4 is a plan view from above of the folding clasp alone, in the open position.
Figure 5:
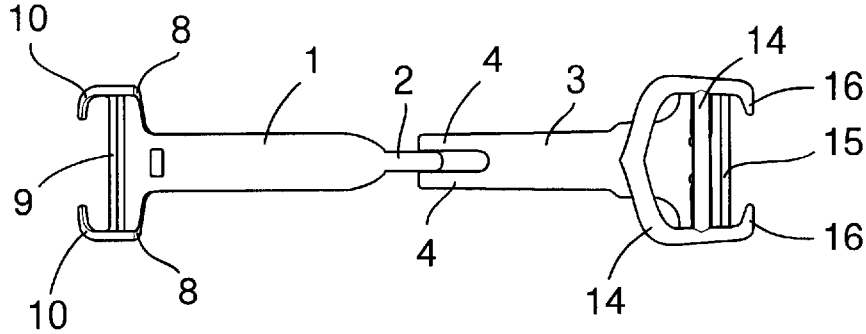
FIG. 5 is a plan view from below of the folding clasp alone, in the open position, certain parts being seen in cross-section.

The folding clasp according to the invention is designed so as to be able to be assembled to the tongues of an interchangeable watch strap. This mounting is designed such that the user can apply and remove the clasp to and from the tongues of the strap without a tool, rapidly and very easily. Thus, a same clasp can serve several interchangeable straps, which is very advantageous particularly when the clasp is of precious metal. Moreover, this mounting ensures the possibility of easily adjusting the length of the strap. Finally, as will be seen later, the assembly and disassembly of the tongues of the strap on the clasp requires only a manipulation of the ends of the tongues of the strap, but no mechanical intervention on the clasp itself.

Conventionally, each tongue of the strap comprises a passage or hole at its end to be connected to the clasp. A screw passes through this hole and is screwed into an end of the clasp. To assemble and disassemble each tongue of the strap, a screwdriver is needed. Moreover, after several manipulations, the screw may no longer keep screwed in or blocked with sufficient force to avoid it unscrewing under the influence of oscillating movement of the tongues of the strap. The strap can thus untimely come apart from the clasp, which can lead to the loss of the watch and strap. This drawback is not present in the folding clasp according to the invention. The folding clasp shown comprises two arms articulated on each other at one of their ends. Of course, the folding clasp according to the invention could comprise three portions articulated on each other.

The illustrated folding clasp comprises a first arm 1 whose one end terminates in a finger 2 and a second arm 3 whose one end terminates in a fork 4. These arms 1, 3 are held together by an axle 5 passing through the two ends of the fork 4 and the end of the finger 2 located between the ends of said fork. The two arms 1, 3 are thus articulated on each other at one of their ends.

The free end of the arm 1 comprises on the one hand an opening 6 adapted to coact with a lug 7 on the other end of the arm 3 of the clasp. This lug 7 and this opening 6 permit snap-in retention of the two arms in the folded and closed position of the clasp.

The free end of the arm 1 comprises a securement device for a tongue of the strap, comprised by a guide 8 having in cross-section a general U shape, an axle 9 formed by a screw or a pin connecting the opposite wings of the guide 8, and holding members formed by the tongues 10 bent toward each other and secured to the wings of the guide and extending in the direction of the longitudinal axis of the clasp.

The user can thus introduce the end of a strap tongue 11 between the axle 9 and the tongues 10 of the guide 8 that extend toward each other, he then reverses the end of this tongue 11 by 180° and threads it between the axle 9 and the dorsal portion of the U-shaped guide 8. The length of the strap can be adjusted by defining the length of the reverse portion of the tongue 11. The tongue 11 of the strap is thus held in its position coupled to the clasp by the axle 9, the dorsal portion of the guide 8, and the tongues 10 extending toward each other.

The free end of the other arm 3 is articulated by means of a screw 12 on the lateral portions 13 of the cover 14 of the clasp. An axle 15 connects the two lateral portions 13 of the cover 14. The upper portion of the cover 14 comprises retaining members 16 for the strap, extending in the direction of the tongue 17 of the strap.

The user threads the end of the tongue 17 of the strap between the retaining members 16 of the cover, bends it about the axle 15 by 180° to secure this tongue 17 on the cover of the clasp.

As will be seen from the drawings, the ends of the tongues 11 and 17 of the strap are made thin such that once folded in two, they have a thickness substantially equal to the thickness of the strap itself.

The strap of course comprises at its two ends before being secured to the watch case, quick securement systems that do not need a tool, for example of the type described in European patent application No. 00103952.8.

Thus, the user can change the strap as he wishes, the interchangeable coupling on the watch case being guaranteed by said rapid securement system that requires no tool, and can thus adapt the new leather strap to a clasp as described in the present application. The user can retain his watch and his clasp, which can for example be of precious metal, and can himself change the strap easily and rapidly without a tool.

This clasp also has the advantage that the two tongues of the strap may be identical, which simplifies and rationalizes the production of the straps.

Finally, thanks to the fact that the adjustment of the length of the strap takes place over the two tongues of the strap, the user can always adjust the strap such that the clasp will be centered on his wrist, always located opposite the watch.

What is claimed is:

1. Folding clasp for an interchangeable watch strap, comprising at least two arms articulated together and foldable against each other, provided with a fixing device to hold the clasp in closed position, characterized by the fact that the free end of one (1) of the arms (1, 3) is provided with a device for securing the end of a strap tongue (11) comprising a guide (8) having in cross-section a general U shape, an axle (9) connecting two lateral wings of the guide (8) and folding members (10) adapted to coact with the upper surface of the tongue (11) of the strap; by the fact that the free end of the other arm (3) of the clasp is pivoted on a cover (14) with the help of a screw (12), this cover (14) having lateral portions (13) connected by an axle (15); and by the fact that the cover (14) of the clasp comprises retaining members (16) adapted to coact with the upper surface of a second tongue (17) of the strap.

* * * * *